US006952900B2

(12) United States Patent
Leurent

(10) Patent No.: US 6,952,900 B2
(45) Date of Patent: Oct. 11, 2005

(54) COVERING STRUCTURE FOR SWIMMING POOLS

(76) Inventor: Ghislain-Henri Leurent, 21, Avenue Winston Churchill, Residence Chanteloup, Mouvaux (FR), 59420

( * ) Notice: Subject to any disclaimer, the term of this patent is extended or adjusted under 35 U.S.C. 154(b) by 261 days.

(21) Appl. No.: 10/398,620

(22) PCT Filed: Sep. 20, 2001

(86) PCT No.: PCT/FR01/02920

§ 371 (c)(1),
(2), (4) Date: Apr. 7, 2003

(87) PCT Pub. No.: WO02/29182

PCT Pub. Date: Apr. 11, 2002

(65) Prior Publication Data

US 2004/0099383 A1 May 27, 2004

(30) Foreign Application Priority Data

Oct. 6, 2000 (FR) ..... 00 12789

(51) Int. Cl.[7] ..... E04B 1/32

(52) U.S. Cl. ..... 52/86; 52/80.1; 52/85; 52/DIG. 17

(58) Field of Search ..... 52/86, 63, 80.1, 52/84, 85, 745.08, 730.2, 730.4, 200, DIG. 17, 222, 273, 204.593, 66, 64, 87

(56) References Cited

U.S. PATENT DOCUMENTS 3,899,858 A * 8/1975 Zanker ..... 52/172
3,961,442 A * 6/1976 Carter ..... 52/86
3,968,604 A * 7/1976 Hills ..... 52/86
4,164,830 A * 8/1979 Bierlich ..... 52/204.593
4,280,306 A * 7/1981 Milinic ..... 52/63
4,885,879 A * 12/1989 Plantier ..... 52/63
4,894,962 A * 1/1990 Conn ..... 52/86
5,295,335 A * 3/1994 Collier ..... 52/86
5,333,421 A * 8/1994 McKenna ..... 52/86
5,611,178 A * 3/1997 Aubert ..... 52/169.6
5,720,577 A * 2/1998 Sanders et al. ..... 405/124
6,082,075 A * 7/2000 Rysgaard ..... 52/745.2
6,085,468 A * 7/2000 Quiring et al. ..... 52/63
6,333,085 B1 * 12/2001 Emek ..... 428/34
6,434,891 B1 * 8/2002 Cameron ..... 52/86
6,637,160 B2 * 10/2003 Brooks ..... 52/66
6,640,505 B1 * 11/2003 Heierli ..... 52/86
6,679,009 B2 * 1/2004 Hotes ..... 52/86
6,789,360 B2 * 9/2004 Silberman et al. ..... 52/66

* cited by examiner

*Primary Examiner*—Carl D. Friedman
*Assistant Examiner*—Nahid Amiri
(74) *Attorney, Agent, or Firm*—Cantor Colburn LLP

(57) ABSTRACT

The invention pertains to a covering structure for covering swimming pools, including several pairs of parallel arches that serve to support flexible panels, the arches being made from a curved profile having lateral walls delimiting a series of parallel guide grooves arranged one above another and perpendicularly to a plane of the arch and receiving the panels, and a protective and elevating border disposed on a lateral edge of at least one of the panels contacting at least one of the internal faces of the guide groove, the height of said border being sufficient to prevent the latter from contacting the profile.

13 Claims, 2 Drawing Sheets

COVERING STRUCTURE FOR SWIMMING POOLS

TECHNICAL FIELD

The invention presented herein pertains to a retractable covering structure that is particularly intended for covering swimming pools. More specifically, it concerns the profiles used to form the arches that constitute the framework of said structure.

BACKGROUND OF INVENTION

It is known that such structures are generally composed of fixed and/or telescopic elements formed by pairs of arches between which panels of a flexible and usually transparent or translucent material are fitted. Some of the panels themselves are maneuverable so that each element may be at least partially uncovered.

Additionally, depending on the desired specifications, the elements themselves may be either fixed or horizontally mobile, sliding into each other in a telescopic fashion.

The arches forming each element are made from a curved, generally enameled-aluminum profile bearing on its lateral faces several grooves designed to support the flexible panels and guide their movement.

Thus, a French patent (FR-A-2 627 530) describes a profile of the type mentioned above that bears, on each of its lateral faces, parallel fins arranged one above the other to form at least three guide grooves. The upper grooves of the profile, which hereinafter shall refer to those grooves situated on the side of the profile with the longest radius of curvature, receive the panels that form the roof section of the element. These roof-section panels are generally fixed in position between the pair of arches that supports them and are usually thicker than the maneuverable panels that form the lateral walls of the structure. In particular, "roof-section" panels may be made from a material having a cellular structure.

The lower grooves of the profile, which hereinafter shall refer to those grooves situated on the side of the profile with the shortest radius of curvature, receive panels that form the vertically maneuverable lateral walls of the element. These panels can be partially raised towards the roof section of the element or lowered to the ground.

These lateral-wall sliding panels are generally made from a solid, transparent material such as polymethyl methacrylate resin or polycarbonate resin. As such, the weight that must be raised vertically in order to partially uncover the lateral parts of each element of the structure is far from negligible.

Moreover, the flexible panels most often used to make each element of such covering structures are flat, regardless of whether the element is intended to be mobile or not. The variable curvature of the panels in the assembled element is obtained when the panels are fitted into place between the curvilinear supporting arches. Consequently, the lateral edges of the panels come naturally into contact with the inner walls of the guide grooves into which they are fitted so that, with repeated maneuvering of the lateral-wall panels (raising and lowering), scratching tends to occur along the edges of the panels in contact with the supporting profiles.

It is also known that, for reasons essentially due to the expansion of the panels, the distance between the two arches forming an element should be greater than the width of the panels, regardless of whether the latter are intended to be fixed (as they are when used as roof-section panels) or vertically maneuverable (as they are when used to form the lateral walls of the structure). As such, there is a tendency for lateral-wall panels to shift slightly from side to side so that the scratch marks along the lateral edges of the panels are apparent over several millimeters on each lateral edge of these maneuverable panels. From an aesthetic point of view, this constitutes a defect that is difficult for users to accept.

Additionally, on account of the friction that accompanies the movement of these lateral-wall panels in their guide grooves, maneuvering the panels requires a greater effort on the part of the user.

SUMMARY OF INVENTION

The purpose of the present invention then is to redress these shortcomings by proposing a means of preventing the occurrence of such scratch marks, which means, moreover, will facilitate the maneuvering of lateral-wall panels along their guide grooves.

Thus, the invention provides a covering structure, particularly intended for covering swimming pools, that may be at least partially uncovered and which comprises several pairs of parallel arches that serve to support flexible panels, especially those made from a transparent or translucent material, said arches being made from a curved profile, the lateral walls of which bear a series of parallel guide grooves arranged one above the other and perpendicularly to the plane of the arch and serving to receive the aforementioned flexible panels, wherein said structure is characterized by the fact that at least one of the panels bears, on each of its lateral edges to be fitted into the guide grooves, a protective and elevating border that comes into contact with at least one of the internal faces of the guide groove, the height of said border under the panel being sufficient to prevent the latter from coming into contact with the profile.

The present invention is also characterized by the fact that the edge of at least one of the internal faces of at least one of the guide grooves shall be beaded, said beading extending along at least part of the length of the profile so as to form a reservoir with the base of the guide groove.

The part of the protective and elevating border situated below the panel shall be thicker than the height of the beading on the edge of the guide groove receiving said panel.

Obviously, the overall thickness of the protective and elevating borders, which are always affixed to and an integral part of the maneuverable panels, shall be less than the height of the opening of the guide grooves of the profile of the arch receiving said panels so that the edges of the panels may be easily inserted, laterally, between each pair of arches forming the covering structure.

The protective border shall necessarily be made from a flexible material, enabling the border and the associated panel to be maneuvered along the variable curvature of the arch, which flexible material shall have a good coefficient of friction with respect to the material used to make the profile.

Moreover, in order to reduce friction even further, the surface of the protective border in contact with the profile may be less than the total surface of the base of the protective border.

It should also be noted that, depending on the type of covering structure to be assembled and the desired level of isolation, it may be beneficial to use panels of varying thickness to form the roof section of an element, and to be able to do so without having recourse to another type of profile, thereby reducing the cost of manufacturing, storing and distributing the profiles.

Consequently, the invention further provides a reversible profile that can used to form the arches of the covering structure and whose design enables it to receive roof-section panels of varying thickness, without having recourse to another type of profile.

Thus, a structure of the aforementioned type is provided in which the upper and lower grooves differ in height, each edge of the internal faces of said grooves being beaded.

In order for the profile to be totally reversible, both the upper and lower faces of the body of the profile are designed to receive an element serving as a junction between the arch formed by said profile and an arch maneuvered into place below the latter.

In a preferred embodiment, the profile comprises a central body in which guide grooves are formed by parallel fins arranged one above the other and perpendicularly to the plane of the arch. Preferentially, the groove that is beaded along the edge of its internal face shall be a lower groove.

BRIEF DESCRIPTION OF THE DRAWINGS

The following is a description of several embodiments of the present invention, which embodiments are provided as non-limiting examples and are shown in the attached diagram in which:

FIG. 5 is a cross-sectional view of another variant embodiment of the profile 7, in accordance with the present invention.

DETAILED DESCRIPTION OF INVENTION

Figure 1A:
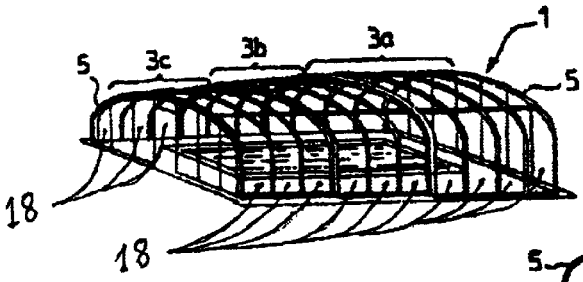
FIGS. 1*a* and 1*b* are perspective views of an example of a covering structure, showing the structure in the closed and open position respectively, in accordance with habitual usage.
Figure 1B:
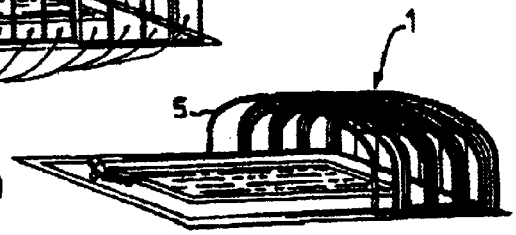

FIGS. 1*a* and 1*b*, which are provided as examples, show a structure 1 used for covering swimming pools, in the closed and open position respectively. This structure consists of three vaults: a fixed vault 3*a*; a mobile vault 3*b*, which, when in the open position, is positioned under vault 3*a*; a third vault 3*c*, which, when in the open position, is positioned under vault 3*b*.

The framework of each of these vaults is of the same type, i.e., it comprises a series of arches 5 that form a certain number of elements.

Thus, vault 3*a* is composed of four elements while vaults 3*b* and 3*c* are composed of three elements each.

Each arch 5 is formed by a profile 7, for example, a profile made from extruded aluminum, said profile 7 often being curved in one or several places and sometimes prolonged by vertical parts fitted to the end of the profile 7 in contact with the ground so that more headroom is available under the lateral part of the structure.

Figure 2:
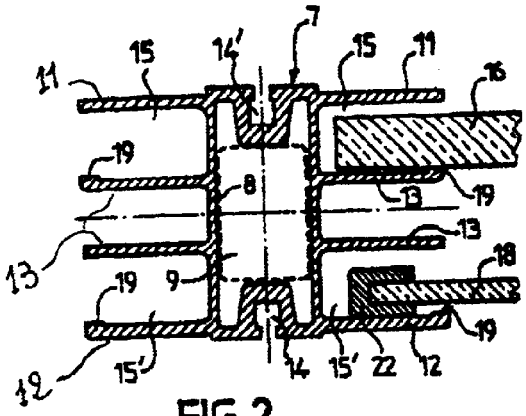
FIGS. 2 and 6 are cross-sectional views of an embodiment of the profile 7, in accordance with the present invention.

A cross-sectional view of this profile 7 is shown in FIG. 2 as an example. The profile 7 consists of a central body 8 that is globally tubular in shape and which receives a shaft 9 (shown in dotted lines in the diagram) the main purpose of which is to fix the arch 5 to the ground and to join portions of arches when the latter are composed of several parts. Each of the two lateral faces of the central body 8 of the profile 7 bears four fins set one above the other to form an arrangement consisting of an external fin 11, an internal fin 12 and two central fins 13. The external fin 11 and the adjacent central fin 13 together form an upper guide groove 15. Likewise, the internal fin 12 and the adjacent central fin 13 together form a lower guide groove 15'.

The upper guide groove 15 is designed to receive the roof-section panel of the element, i.e., a relatively thick panel 16 that is immobile with respect to the profile 7.

The panels 16 may be made from any flexible, and preferably transparent or translucent, plastic material, in particular from a polycarbonate resin generally possessing a cellular structure.

The lower guide groove 15' is designed to receive the vertically maneuverable sliding panels 18 that are fitted, as shown in FIG. 1*a*, on either side of the arches and descend, in this case, right down to the ground.

Figure 3:
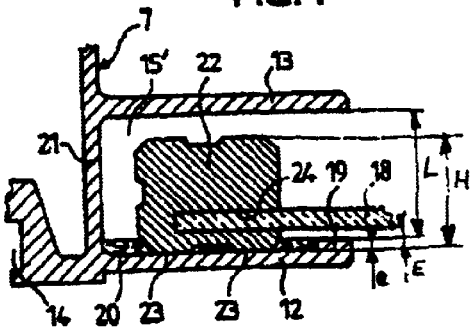
FIG. 3 is a partial cross-sectional view of a lower guide groove of the profile 7, in accordance with the present invention, into which a vertically maneuverable panel 18 is fitted.
Figure 6:
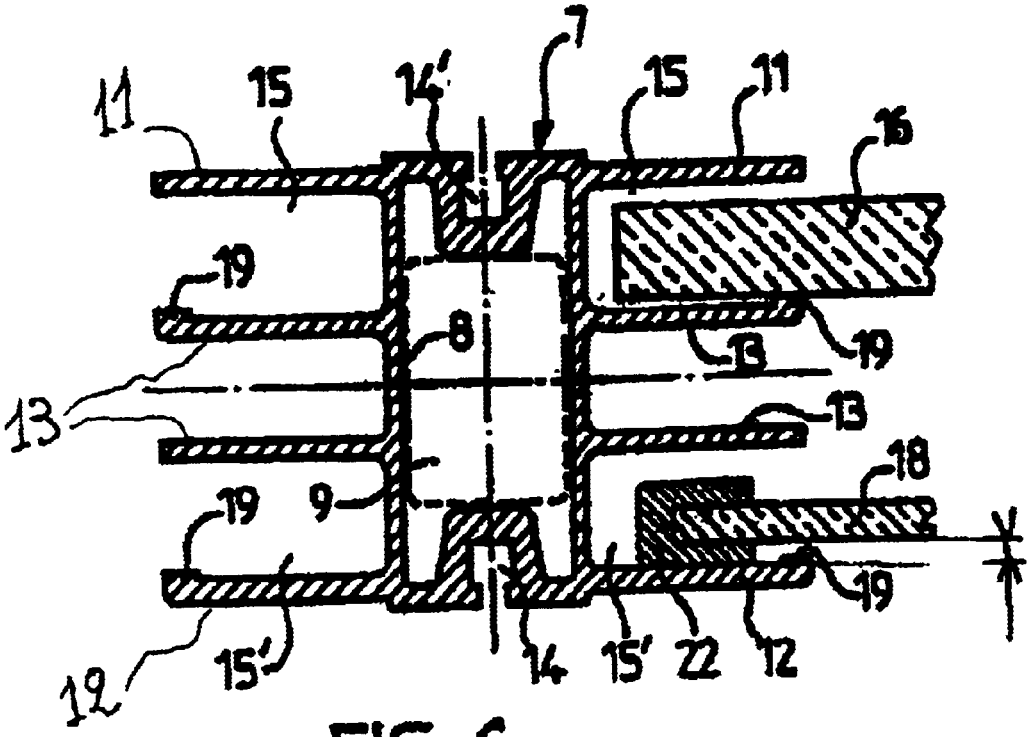

FIG. 3 is a blown-up view of the lower guide groove 15'. The edge of the lower internal wall of the groove 15' is beaded, said beading 19, the thickness of which is represented by the letter e, extending along the entire length of the profile 7. This beading 19 forms, within the grooves 15', a sort of buffer reservoir 20 intended to receive and collect run-off water and facilitate its flow towards the base of the arch.

It has been observed that while the flow of run-off water poses no problems in the steeply sloping parts of the profile the same cannot be said of those parts of the profile with a less pronounced slope.

On account of the beading 19, a sort of buffer reservoir 20 is created with the internal base of the groove formed by the fins 12 and 13 of the profile 7, or with the base of the groove formed by the fins 11 and 13 when the profile 7 is used in the reversed position, said reservoir enabling the temporary accumulation of run-off water for as long as it is necessary for the latter to be evacuated.

It has thus been observed that this beading prevents run-off water from entering the structure.

In accordance with the present invention, and as shown in FIGS. 2 and 3, the vertically maneuverable panels 18 are not in direct contact with the fins 12 and 13 of the profile 7. This is due to the fact that protective and elevating borders 22 are affixed to the lateral edges of each of these panels 18.

These protective and elevating borders are made from a material, generally plastic, that possesses a good degree of flexibility and hardness, as well as a low coefficient of friction with respect to the profile 7.

The protective and elevating border 22 incorporates a slot 24 along its entire length into which the lateral edges of the panel 18 are inserted, by force-fitting, for example (other means of fixing the protective border 22 to the panel 18 may be envisaged, including but not limited to the use of glue or screws).

In a preferred embodiment, the base 23 of the protective and elevating border 22 that is in contact with the internal face of the groove 15' is designed in such a way as to reduce its area of contact with the latter so as to minimize the coefficient of friction with respect to the profile 7, while still providing a sufficient degree of support.

The thickness E of the part of the protective and elevating border situated under the panel shall be sufficient to prevent the vertically maneuverable panel 18 from coming into contact with the beading 19 of the profile 7.

Obviously, the total height H of the protective and elevating border 22, when fixed to the vertically maneuverable panel 18, shall be less than the height L of the entrance of the groove 15' receiving said panel 18 so that the edge of the latter may be easily inserted, laterally, into said groove 15'.

The present invention is particularly interesting insofar that it prevents scratch marks from occurring on the panel 18 since the latter cannot come into contact with the fins 12 and 13 of the guide groove 15'.

Thus, this protective and elevating border 22 has two functions: on the one hand, it prevents the occurrence of scratch marks on the maneuverable panel 18, and on the other hand, it facilitates the vertical maneuverability of the panel 18 within the guide groove 15'.

Of course, the protective and elevating border 22 may consist of a single element or several elements that continuously extend(s) along the entire length of the maneuverable panel 18, or, conversely, it may consist of several distinct elements that are distributed, evenly or otherwise, along said length.

Figure 4:
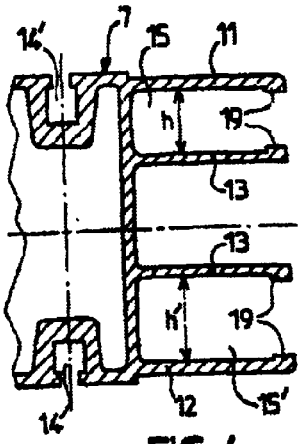
FIG. 4 is a partial cross-sectional view of a variant embodiment of the profile 7, in accordance with the present invention.

In one embodiment of the present invention, shown in FIG. 4, the upper guide grooves 15 and the lower guide grooves 15' differ in height, h and h' respectively, and both edges of the internal surfaces of these grooves are beaded 19. As such, a reversible profile is obtained, which profile can be used in either of two positions: a position (FIG. 4) in which a relatively thin roof-section panel 16 can be mounted, and a second position (corresponding to a 180-degree rotation of the profile as shown in FIG. 4) in which a thicker roof-section panel can be mounted.

It should also be noted that the width of the base of the protective and elevating border 22, which is associated with and is an integral part of the maneuverable panel 18, shall be, of necessity, less than the width of the base of the reservoir 20 to allow for the expansion of the panel 18 and the possible withdrawal of said panel from the lower guide groove 15' of each pair of arches comprising the structure, or from the upper guide groove 15 when the profile 7 is used in the reversed position.

The central body of the profile 7 generally incorporates a slot 14 that extends along its lower surface, i.e., the side of the arch 5 with the shortest radius of curvature, which slot is designed to receive the heel of a flexible element, such as a plastic broom in particular, a brush, etc., that serves as a vertical junction between the arch formed by said profile and an arch maneuvered into place below the latter.

In order for the profile 7 to be considered as totally reversible it shall incorporate a second slot 14' extending along its upper surface, i.e., the side of the arch 5 with the longest radius of curvature.

With such an embodiment the covering structure may be assembled in either of two possible configurations, using only one type of profile.

Figure 5:
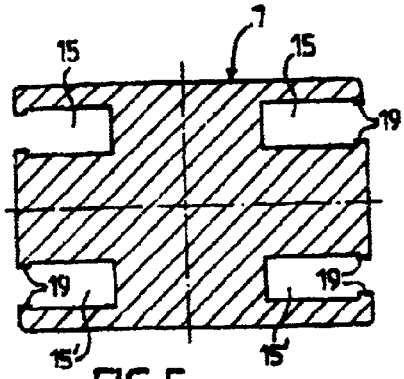
FIG. 5 is a cross-sectional view of another variant embodiment

FIG. 5 shows a cross-sectional view of another embodiment of the profile 7 used to make the arches 5 that form the framework of the covering structure. In this figure the profile 7 consists of a solid, rectangular-shaped body in which lateral upper and lower grooves have been cut out.

These grooves form the grooves (15 and 15' respectively) that receive the fixed (roof-section) panels 16 and the maneuverable panels 18.

What is claimed is:

1. A covering structure for covering swimming pools, comprising:

several pairs of parallel arches;

flexible panels supported by the arches;

a curved profile forming each of the arches and including lateral walls;

a series of parallel guide grooves delimited the lateral walls arranged one above another and perpendicularly to a plane of the respective arch, the guide grooves receiving the flexible panels;

two parallel inner faces and a base wall formed on the profile at each of the guide grooves;

a protective and elevating border disposed on each lateral edge of at least one of the panels;

wherein the border comes into contact with at least one of the internal faces of the groove, a height of the border being sufficient to prevent the panel from contacting the profile.

2. A structure in accordance with claim 1, wherein an edge of at least one of the internal faces of at least one of the grooves includes a beading extending along at least part of a length of the profile to form a buffer reservoir with the base of the groove.

3. A structure in accordance with claim 2, wherein the height of the protective border is greater than a height of the beading on the edge of the groove into which the panel is fitted.

4. A structure in accordance with claim 1, wherein the profile comprises a central body in which the guide grooves are formed by parallel fins arranged one above another and perpendicularly to the plane of the arch.

5. A structure in accordance with claim 4, wherein the central body is tubular in shape.

6. A structure in accordance with claim 2, wherein the groove incorporating the beading along the edge of the internal face is a lower guide groove.

7. A structure in accordance with claim 1, wherein the protective and elevating border comprises a flexible material having a sufficient coefficient of friction with respect to a material used to make the profile.

8. A structure in accordance with claim 1, wherein a surface of the protective and elevating border in contact with the profile is less than a total surface of a base of the protective and elevating border.

9. A structure in accordance with claim 1, wherein the guide grooves comprise upper and lower guide grooves, the upper and lower guide grooves differing in height.

10. A structure in accordance with claim 9, wherein the upper and lower guide grooves comprise a beading on an edge of the respective internal faces.

11. A structure in accordance with claim 9, wherein both the upper and lower faces of the the profile comprise a means of receiving an element serving as a junction between the arch formed by the profile and an arch maneuvered into place below the arch formed by the profile.

12. A structure in accordance with claim 2, wherein a total height of the protective and elevating border and the associated panel is less than a height of an entrance of the guide groove receiving the panel.

13. A structure in accordance with claim 2, wherein a width of a base of the protective and elevating border that is associated with and is an integral part of a vertically maneuverable panel is less than a width of a base of the reservoir to allow for an expansion of the panel and a possible withdrawal of the panel from the guide groove.

* * * * *